US011801519B2

(12) United States Patent
McCreary et al.

(10) Patent No.: US 11,801,519 B2
(45) Date of Patent: Oct. 31, 2023

(54) NOISE SUPPRESSION SYSTEM

(71) Applicant: Figure, Inc., Lorton, VA (US)

(72) Inventors: Leonard McCreary, Lorton, VA (US); Chris Holtzclaw, Lorton, VA (US); Jonathon McDaniels, Lorton, VA (US)

(73) Assignee: Figure, Inc., Lorton, VA (US)

( * ) Notice: Subject to any disclaimer, the term of this patent is extended or adjusted under 35 U.S.C. 154(b) by 0 days.

(21) Appl. No.: 17/962,646

(22) Filed: Oct. 10, 2022

(65) Prior Publication Data

US 2023/0041364 A1 Feb. 9, 2023

Related U.S. Application Data

(63) Continuation of application No. 16/885,454, filed on May 28, 2020, now Pat. No. 11,491,497.

(60) Provisional application No. 62/853,793, filed on May 29, 2019.

(51) Int. Cl.
*B05B 1/00* (2006.01)
*G10K 11/16* (2006.01)

(52) U.S. Cl.
CPC ..... *B05B 1/002* (2018.08); *G10K 11/16* (2013.01)

(58) Field of Classification Search
CPC ..... B05B 1/002; G10K 11/16
USPC ..... 239/591
See application file for complete search history.

(56) References Cited

U.S. PATENT DOCUMENTS 3,762,653 A * 10/1973 Gibel ..... B05B 1/005 239/553.3
3,982,605 A * 9/1976 Sneckenberger ..... B05B 1/005 239/DIG. 21
3,984,054 A * 10/1976 Frochaux ..... B08B 5/02 239/DIG. 21

* cited by examiner

*Primary Examiner* — Paul Kim
(74) *Attorney, Agent, or Firm* — Seyfarth Shaw LLP

(57) ABSTRACT

Disclosed is a noise suppressor for use inside a nozzle and adjacent a nozzle liner. The suppressor can include an inlet with a cross-sectional area larger than that of the nozzle liner outlet. The suppressor can also have an entrance length with a diverging cross-sectional area, and an exit length extending from the entrance length. By incorporating this geometry, the noise suppressor reduces noise and improves performance of the apparatus in which the suppressor is used.

19 Claims, 10 Drawing Sheets

NOISE SUPPRESSION SYSTEM

GOVERNMENT LICENSE RIGHTS

This invention was made with government support under contract nos. FA822215C0005 and FA822214M0005 awarded by the Department of the Air Force. The government has certain rights in the invention.

TECHNICAL FIELD OF THE INVENTION

The presently disclosed embodiments relate to noise reduction devices and methods. In particular, the presently disclosed embodiments relate to noise reduction devices for use in a blasting gun or another noise-creating apparatus.

BACKGROUND

Blasting guns are conventionally used to clean and abrade surfaces of unwanted material such as rust or paint. Blasting guns use pressurized air or fluid to force mineral particles or other matter, known generally as abrasive blast media, against the surface to be treated. The interior of the blasting gun can provide a cross-section that allows high pressure or high velocity air or fluid to blast material against a surface, and can further include a ceramic coating to protect against corrosion over time.

Blasting guns emit a large amount of noise during use, which creates an occupational safety hazard. They are commonly so loud that even with double hearing protection comprising high-attenuation earplugs under earmuffs, bone conduction is sufficient to permanently damage the user's hearing with prolonged exposure. For the U.S. Department of Defense (DoD), noise-induced hearing damage, including hearing loss and tinnitus, affect over 1.2 million veterans and cost over $1 billion in disability claims.

Noise can cause additional problems in, for example, defense applications where the user of the blasting gun wishes to be inconspicuous and where loud noises run counter to that goal. For infrastructure applications in densely populated areas it is likewise desirable to avoid nuisance noise to allow construction or maintenance crews to work overnight. It is therefore a desire in the field of blasting guns to reduce the noise emitted by the blasting gun while simultaneously avoiding noise suppression techniques that may reduce the velocity at which the abrasive media is blasted from the blasting gun, or that would otherwise compromise the performance of the blasting gun.

Prior art noise suppressors reduced the noise of a blasting gun by attaching a separate silencer device onto the end of the gun nozzle. For example, U.S. Pat. No. 3,982,605 ("Sneckenberger") discloses a nozzle silencer with a straight diameter bore and where the silencer diameter is larger than the nozzle outlet diameter. However, noise suppressors such as the silencer of Sneckenberger reduce the overall performance of the blasting gun while only marginally reducing the noise emitted by the gun.

SUMMARY

The presently disclosed embodiments relate generally to a noise suppressor for an apparatus that causes noise during use, such as a blasting gun. The suppressor can be disposed within a nozzle of the apparatus adjacent a nozzle liner and can include a cylindrical opening such as a bore where air or fluid passes during use. The suppressor can have an inlet cross-sectional area that is greater than the nozzle liner outlet cross-sectional area. The suppressor can further have a diverging cross-sectional area leading from the suppressor inlet through an entrance length; and, in some embodiments, a straight or diverging (i.e., non-converging) cross-sectional area in an exit length that extends from the entrance length.

The present inventors discovered the above geometry improves noise suppression and overall performance during use as compared to prior art blasting gun noise suppressors. For example, the noise suppressor of the presently disclosed embodiments, together with the nozzle liner, improved the kinetic energy and velocity of blasted particles as compared to an off-the-shelf nozzle lacking such a suppressor.

In particular, the presently disclosed embodiments include a suppressor for use in a nozzle having a nozzle liner with a liner inlet receiving air or fluid and a liner outlet distributing air or fluid. The suppressor includes a suppressor inlet located adjacent the liner outlet at a first end of the suppressor and receiving the air or fluid from the liner outlet, a suppressor outlet located at a second end of the suppressor opposite the first end, and a suppressor body extending from the suppressor inlet to the suppressor outlet. The suppressor further includes an entrance length extending from the suppressor inlet in an axial direction and having an entrance length cross-sectional area that increases along the entrance length as a distance from the suppressor inlet increases, and an exit length extending from the entrance length to the suppressor outlet.

The presently disclosed embodiments further include a nozzle including a nozzle jacket having a first jacket end and a second jacket end opposite the first jacket end, a nozzle liner disposed within the jacket proximate the first end, the nozzle liner having a liner inlet receiving air or fluid and a liner outlet distributing air or fluid, and a liner body extending therebetween, and a suppressor. The suppressor includes a suppressor inlet located adjacent the liner outlet at a first end of the suppressor and receiving the air or fluid from the liner outlet, a suppressor outlet located at a second end of the suppressor opposite the first end, and a suppressor body extending from the suppressor inlet to the suppressor outlet. The suppressor further includes an entrance length extending from the suppressor inlet in an axial direction and having an entrance length cross-sectional area that increases along the entrance length as a distance from the suppressor inlet increases, an exit length extending from the entrance length, and an interface located at an intersection of the entrance length and the exit length. The exit length extends from the interface to the suppressor outlet.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1A:
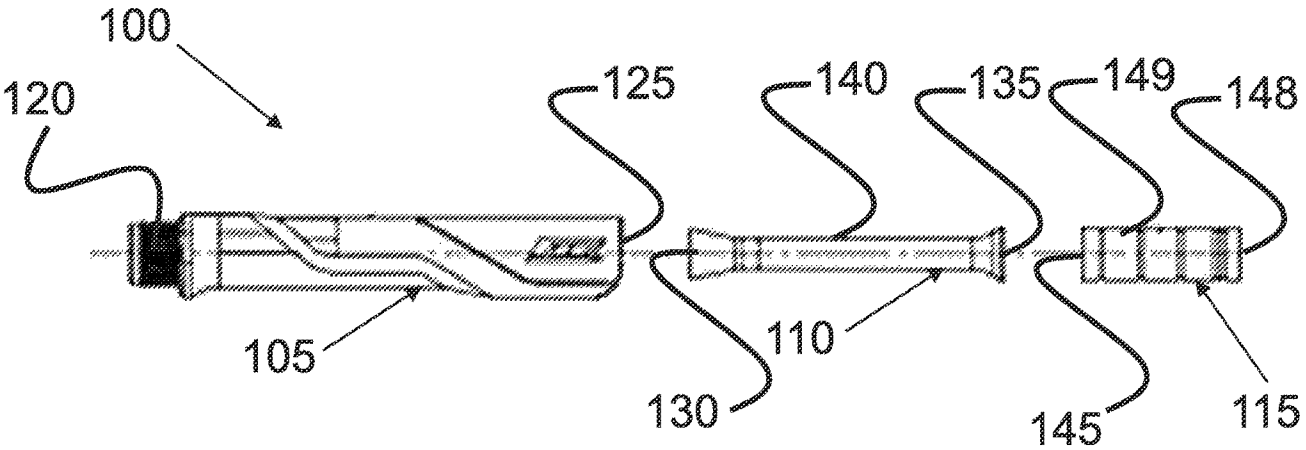
FIGS. 1A-1C respectively illustrate an exploded side view, a side sectional view, and a partial enlarged view of a nozzle according to at least one of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "presently disclosed embodiments" is not intended to limit the scope of the claimed invention and is instead a term used to discuss exemplary embodiments of the invention for explanatory purposes only.

The presently disclosed embodiments relate generally to a noise suppressor for use inside a nozzle and adjacent a nozzle liner. The suppressor can include a cylindrical opening extending through the nozzle to allow air or fluid to pass during use. The suppressor inlet can have a cross-sectional area larger than that of the nozzle liner outlet to create a step-like transition between the liner and suppressor. The suppressor can also have a diverging cross-sectional area leading from the suppressor inlet through an entrance length; and an exit length extending from the entrance length to the nozzle outlet. This geometry of noise suppressor improves upon prior art noise suppressors by reducing noise from the apparatus within which the suppressor is used, but also by improving overall performance of the apparatus by increasing the exit velocity, kinetic energy, or strip speed of the apparatus (e.g., a blasting gun).

Figure 1B:
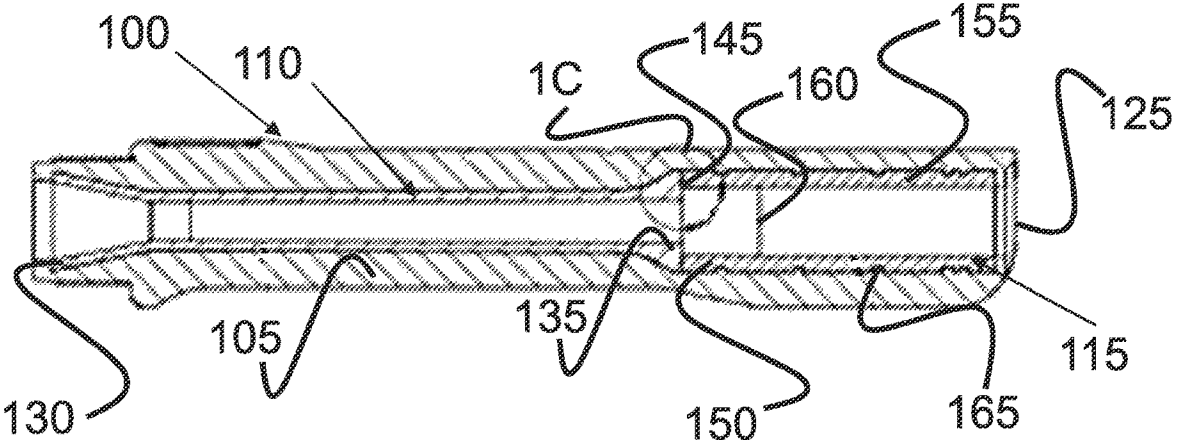
Figure 1C:
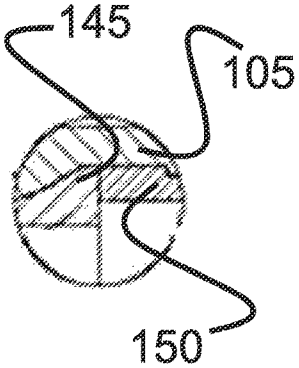

FIGS. 1A-1C respectively illustrate an exploded side view, a side sectional view, and a partial enlarged view of a nozzle 100 according to at least one of the presently disclosed embodiments. As shown, the nozzle 100 can include a jacket 105 having inside a nozzle liner 110 and suppressor 115. The jacket 105 can include threads 120 at a first end for threading to, e.g., a hose or other outlet pipe of a blasting gun; and a nozzle outlet 125 at a second end opposite the first end for releasing the blasted air and particles. In an embodiment, the jacket 105 has an impact resistance of at least 500 times the force of gravity (e.g., 500 G). As shown in, for example, FIGS. 2A and 2B, the nozzle liner 110 includes a liner inlet 130 and a liner outlet 135 with a liner body 140 extending therebetween. The suppressor 115 can similarly include a suppressor inlet 145 and a suppressor outlet 148 with a suppressor body 149 extending therebetween. In some embodiments, for example, as shown in FIG. 1C, the interface between the liner outlet 135 and the suppressor inlet 145 can be stepped so as to impart aerodynamic flow separation of the air or fluid from the internal wall of the suppressor 115. This geometry results in a reduction of aero-acoustic energy at certain operating pressures. The nozzle liner 110 and suppressor 115 can also be composed of the same or different materials.

As shown in, for example, FIG. 1B, the suppressor 115 can optionally include a mechanical bonding structure 165 to improve the coupling between the suppressor 115 and the jacket 105 of the nozzle 100. The mechanical bonding structure 165 can be any shape, can extend partially or fully around the outer circumference of the suppressor 115, or can be cut into the jacket 105 itself, in an embodiment. Exemplary mechanical bonding structures 165 include grooves, holes, knurling, studs, roughness, scratches, protuberances, and the like. The nozzle 100 can include any number of mechanical bonding structures 165 or can include no mechanical bonding structures 165 at all, in an embodiment. The mechanical bonding structures 165 can either receive adhesive, create a frictional engagement between the jacket 105 and suppressor 115, or can allow expansion of the suppressor 115 within the nozzle 100 until firmly positioned inside.

The nozzle 100 or either of the nozzle liner 110 and suppressor 115 can include a chip or other identification device that allows the nozzle 100, liner 110, or suppressor 115 to be identified. For example, a radio frequency identification (RFID) chip can be embedded in the nozzle 100 to identify the nozzle 100 and the appropriate liner 110 and suppressor 115 to use with the nozzle 100. The appropriate liner 110 and suppressor 115 can include various geometries or inlet/outlet diameters that better suppress noise and improve performance, as discussed below in more detail.

Figure 2A:
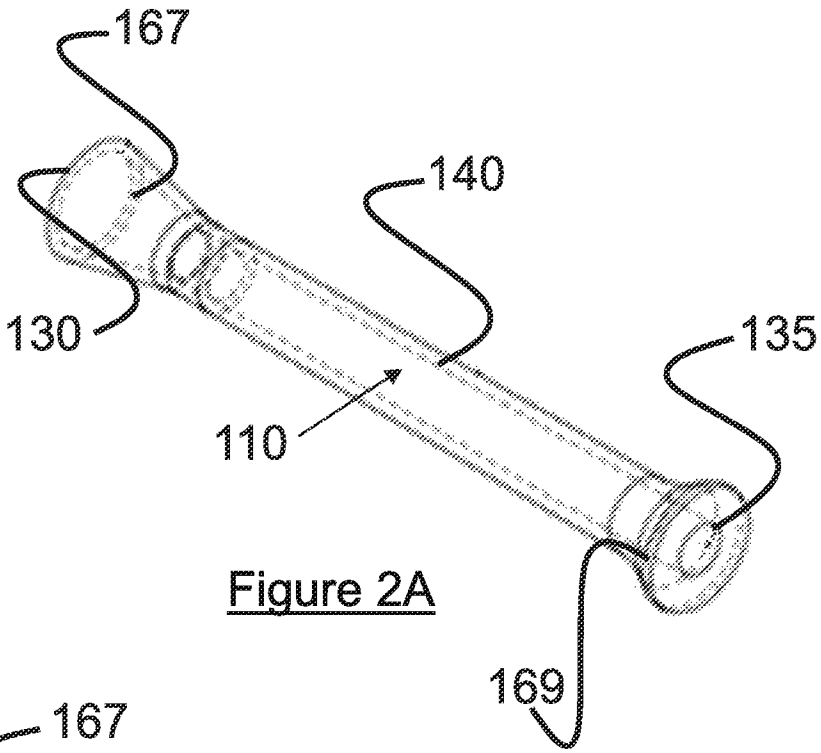
FIGS. 2A and 2B respectively illustrate front perspective and front sectional views of a nozzle liner according to at least one of the presently disclosed embodiments.
Figure 2B:
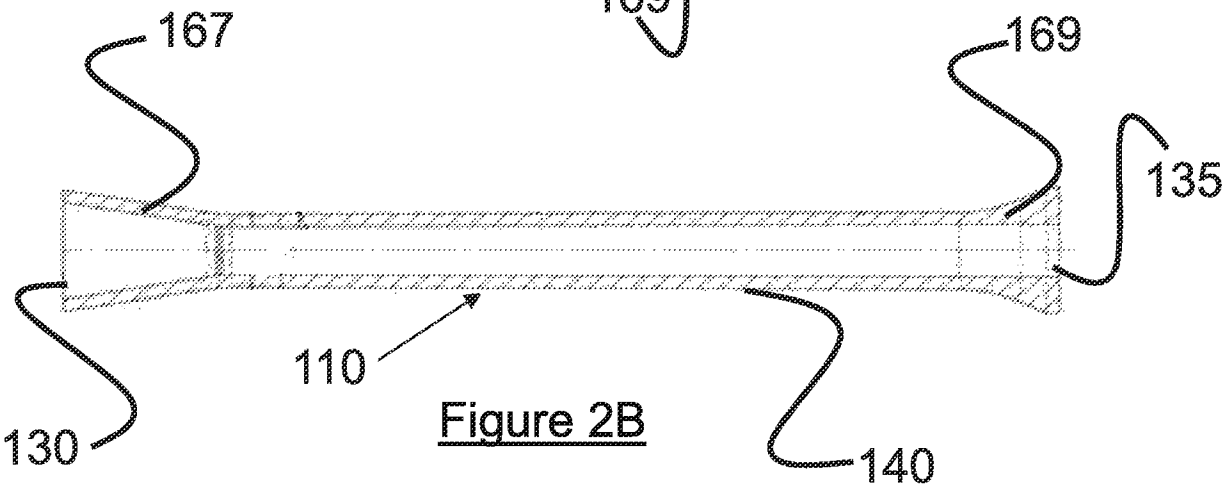

FIGS. 2A and 2B respectively illustrate front perspective and front sectional views of an exemplary nozzle liner 110 according to at least one of the presently disclosed embodiments. As shown, the nozzle liner 110 can further include an entrance section 167 and an exit section 169 that are designed to fit within the nozzle 100 adjacent the jacket 105 during use. The liner inlet 130 can be located within the entrance section 167 and the liner outlet 135 can be located within the exit section 169. The entrance section 167 and exit section 169 can be any shape, including but not limited to those illustrated in FIG. 4, for example. Similarly, the liner inlet 130, liner outlet 135, suppressor inlet 145, and suppressor outlet 148 can be any shape, including but not limited to those illustrated in FIG. 5.

Figure 3A:
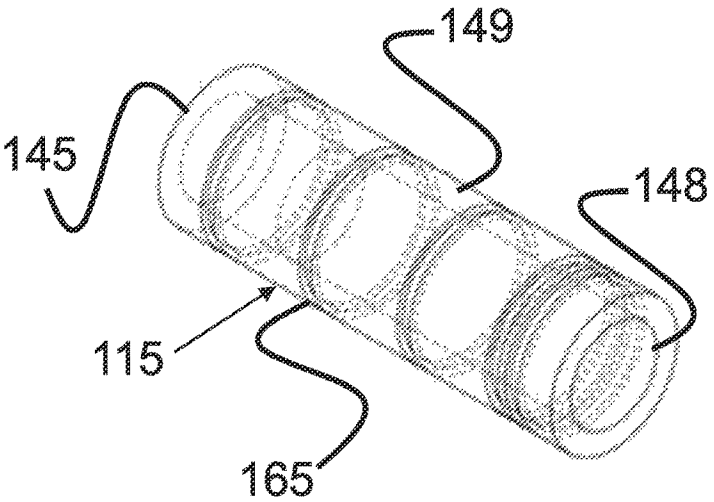
FIGS. 3A and 3B respectively illustrate front perspective and front sectional views of a suppressor according to at least one of the presently disclosed embodiments.
Figure 3B:
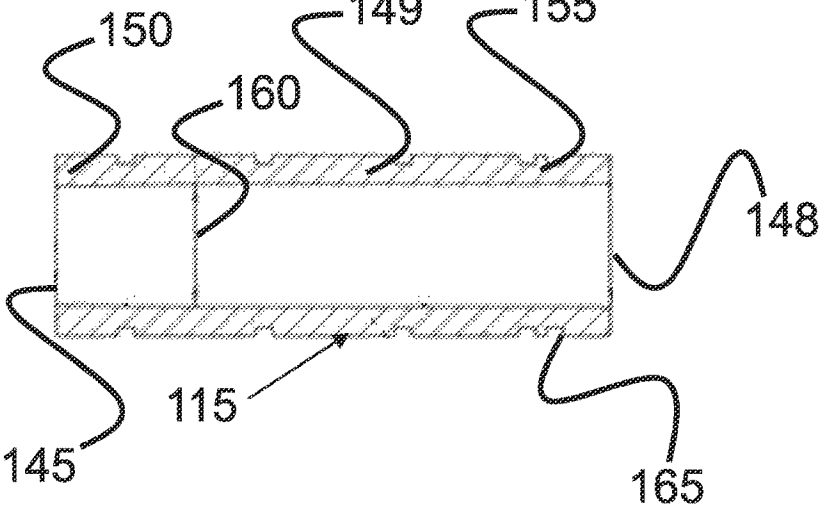
Figure 3C:
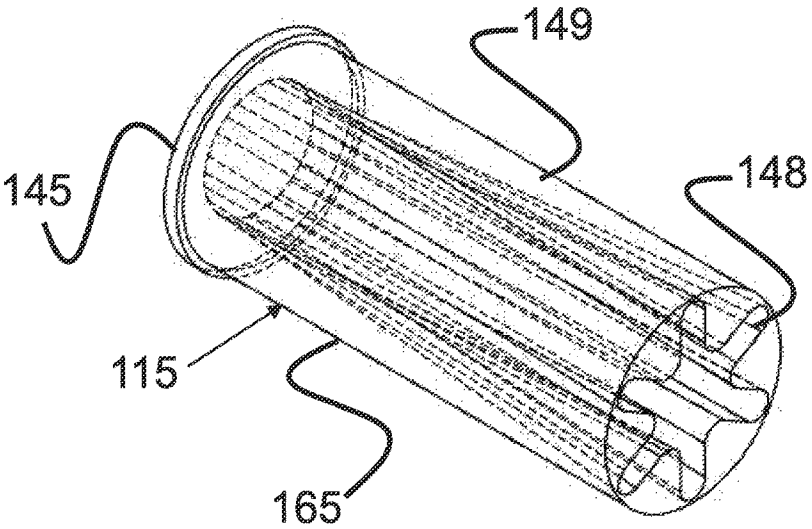
FIGS. 3C and 3D respectively illustrate front perspective and front sectional views of a suppressor having a "circle-to-lobed" cross-section according to at least one of the presently disclosed embodiments.
Figure 3D:
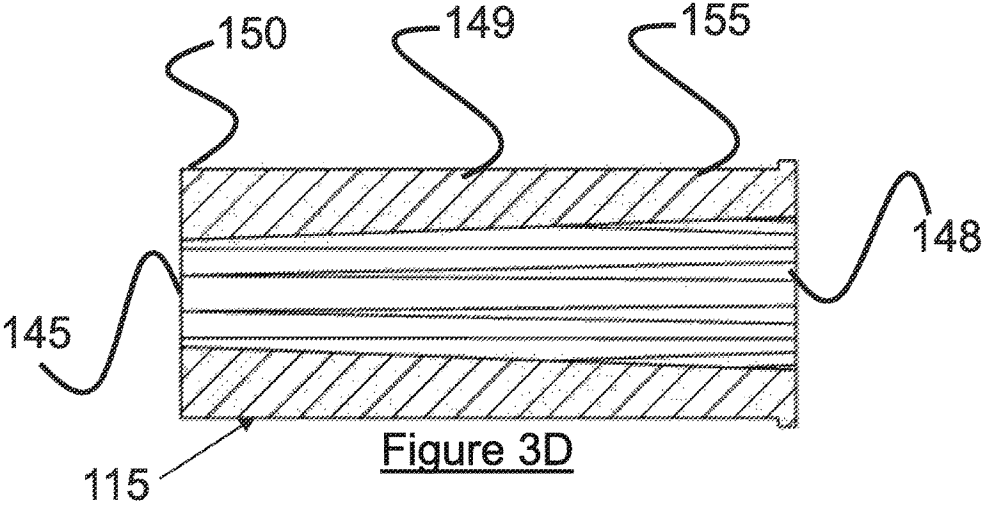
Figure 3E:
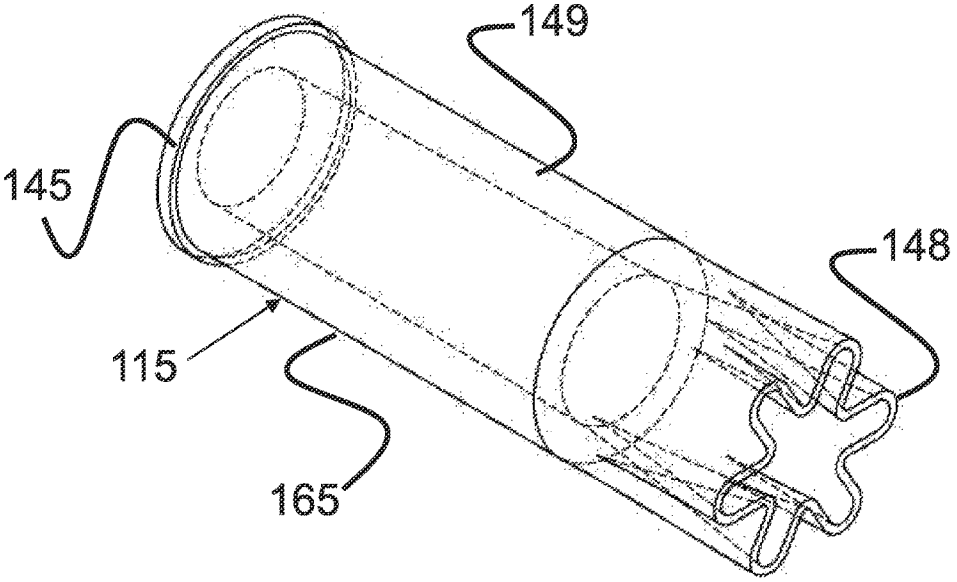
FIGS. 3E and 3F respectively illustrate front perspective and front sectional views of a suppressor having a "circle-to-circle-to-lobed" cross-section according to at least one of the presently disclosed embodiments.
Figure 3F:
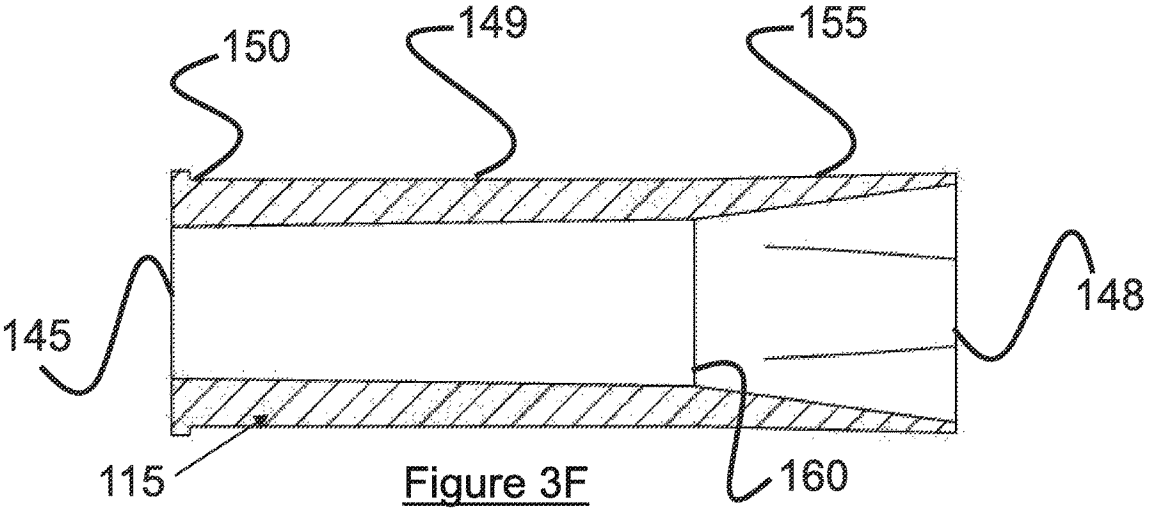

As shown in, for example FIGS. 3A-3F, the suppressor 115 can begin at the suppressor inlet 145 and extend along an entrance length 150 in a diverging manner. Put another way, the entrance length 150 has a cross-sectional area that increases along the entrance length 150 as the distance from the suppressor inlet 145 increases. For example, the suppressor inlet 145 can have a cross-sectional area that is greater than the cross-sectional area of the liner outlet 135. In this manner, and as shown in FIG. 1C, the transition from the liner outlet 135 to the suppressor inlet 145 is a step-type transition, leading to a gradually increased diameter or cross-sectional area entrance length 150. The suppressor 115 can further include an exit length 155 with the same or a different shape as the entrance length 150. For example, and without limitation, FIGS. 3C and 3D respectively illustrate front perspective and front sectional views of a suppressor having a "circle-to-lobed" cross-section; and FIGS. 3E and 3F respectively illustrate front perspective and front sectional views of a suppressor having a "circle-to-circle-to-lobed" cross-section. As shown in FIGS. 3A, 3B, 3E, and 3F, an interface 160 can be provided between the entrance length 150 and the exit length 155 and can serve as the transition point between the entrance length 150 and the exit length 155. Alternatively, as shown in FIGS. 3C and 3D, the transition between the entrance length 150 and exit length 155 can be a smooth one and in such instances need not include a defined interface 160.

The present inventors determined the above geometry improves noise suppression characteristics and overall performance by providing a diverging rather than straight bore entrance length with a step-wise transition between the liner outlet 135 and the suppressor inlet 145. For example, the shape separates the flow of the outgoing air or fluid while spacing the flow of the outgoing air from the inner walls of the suppressor for an extended period of time, reducing friction between the suppressor and air or fluid and improving performance of the blasting gun or other apparatus as a result.

Figure 4:
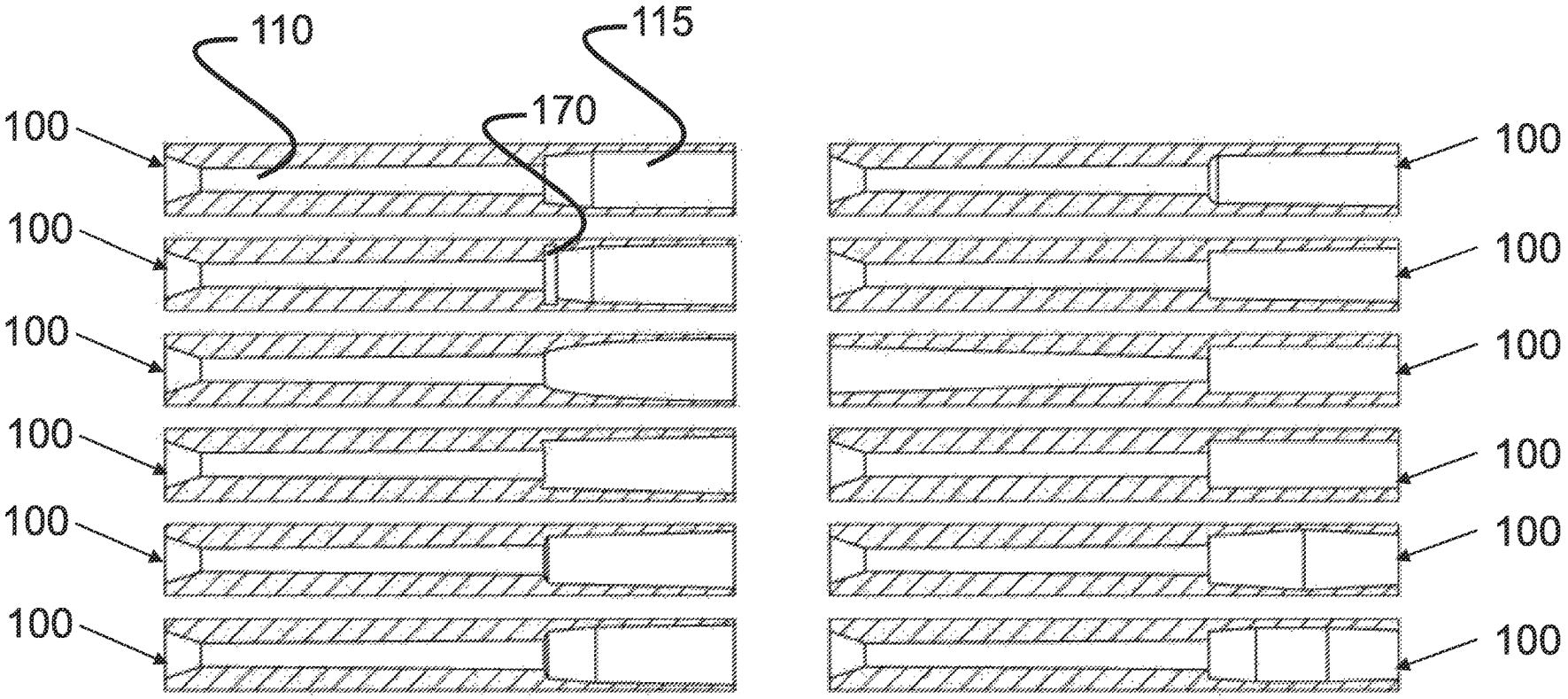
FIG. 4 illustrates front sectional views of exemplary nozzles according to at least some of the presently disclosed embodiments.
Figure 5:
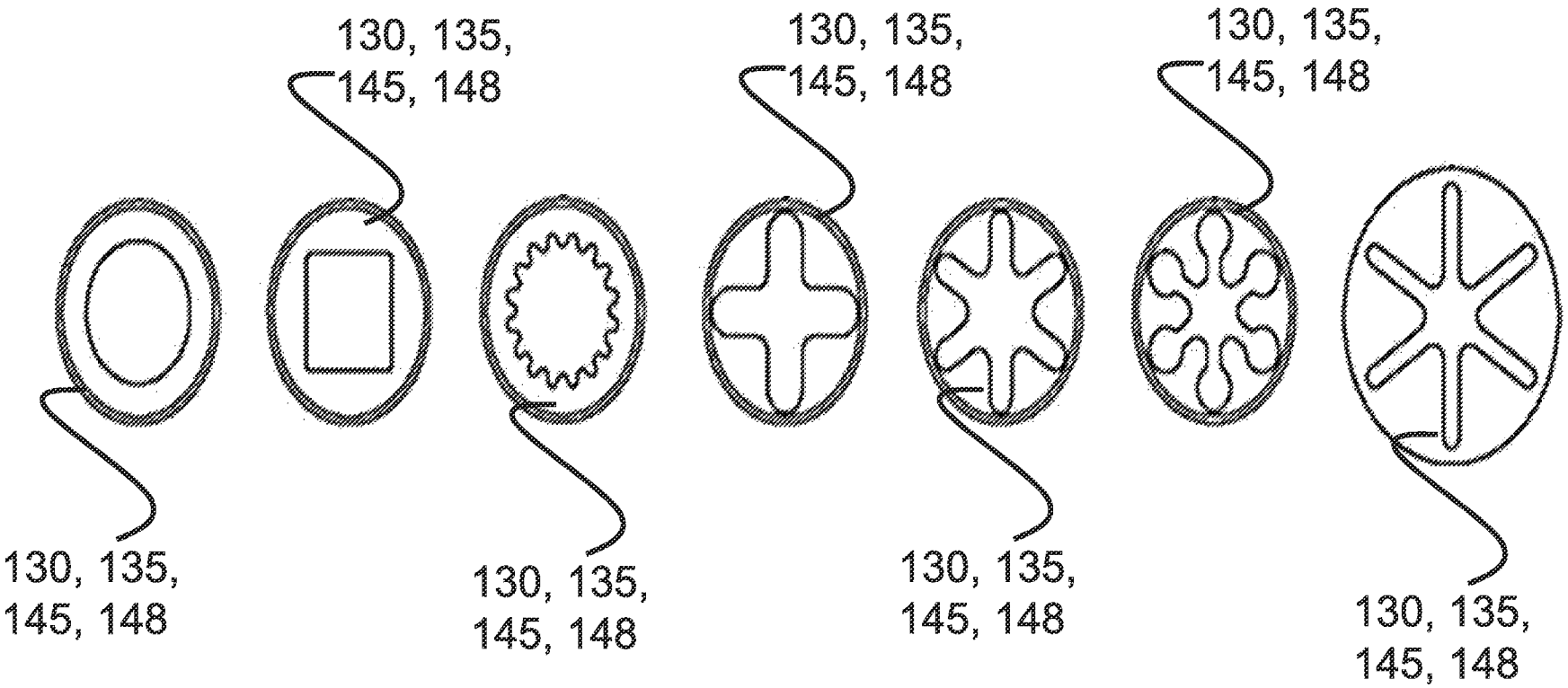
FIG. 5 illustrates suitable cross-sectional shapes of the openings of the nozzle liner inlet and outlet and/or suppressor inlet and outlet according to at least some of the presently disclosed embodiments.

FIG. 4 illustrates front sectional views of exemplary nozzles 100 according to at least some of the presently disclosed embodiments. As shown, the nozzle liner 110 leads to the suppressor 115 in various different geometric cross-sectional shapes. An annular chamber 170 can further be provided between the liner 110 and suppressor 115 to further suppress noise while improving performance.

Figure 6:
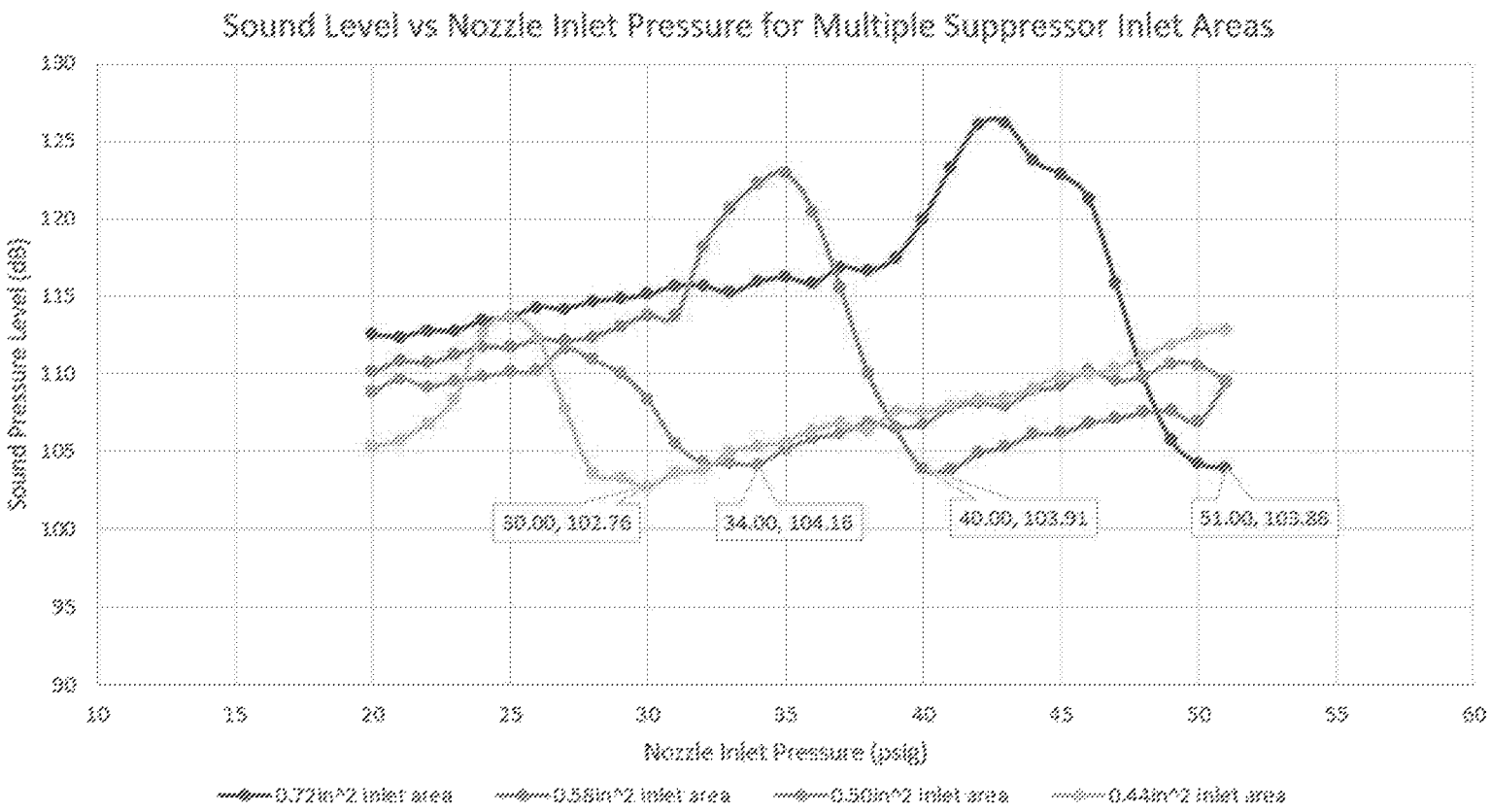
FIG. 6 illustrates a graph of the sound pressure level (y axis) relative to the nozzle inlet pressure (x axis) for four separate suppressor inlet areas according to at least one of the presently disclosed embodiments.
Figure 7:
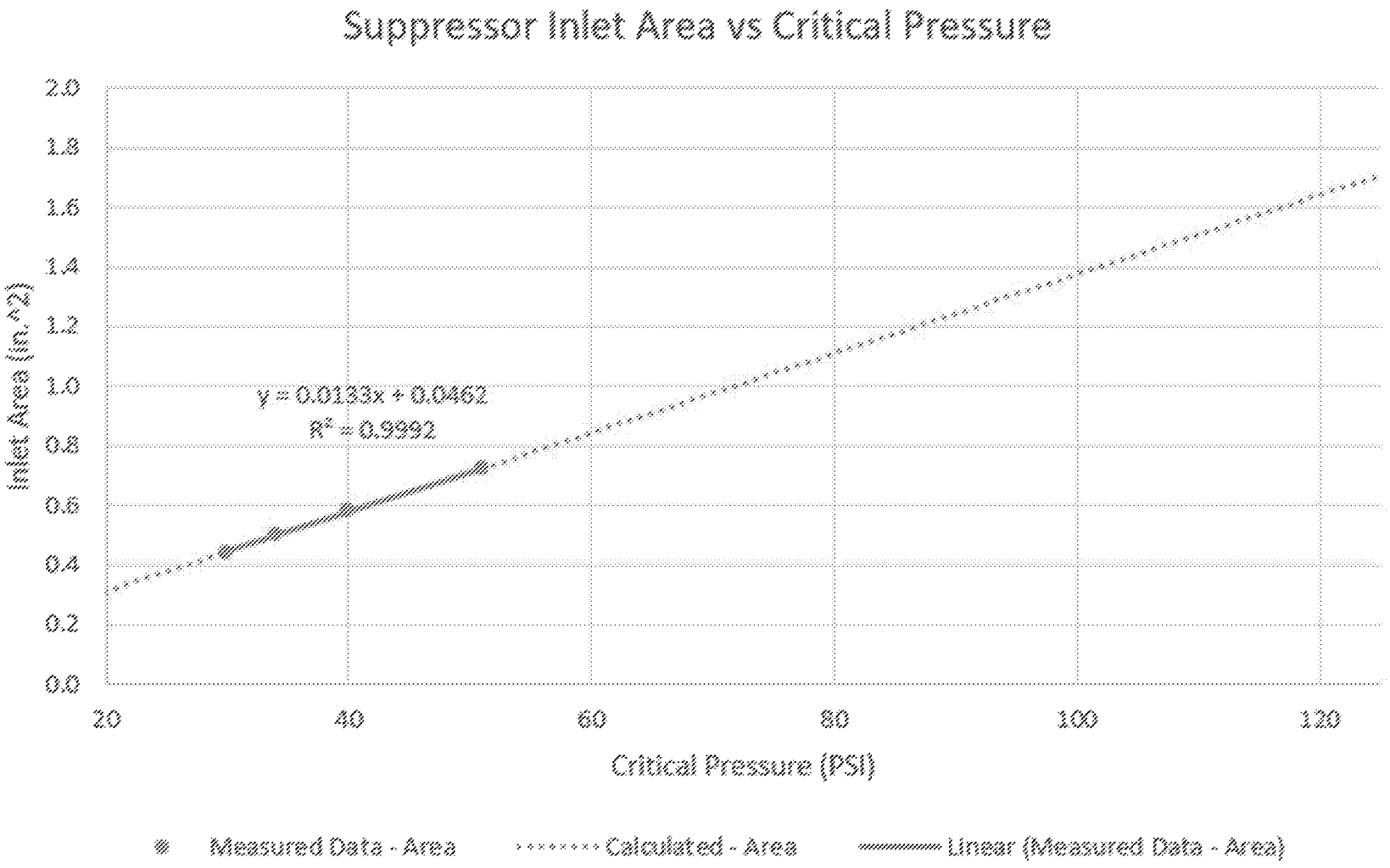
FIG. 7 illustrates a graph of the suppressor inlet area (y axis) relative to the critical pressure (x axis) based on the data points provided by plots of the four separate suppressor inlet areas and the formula of the resulting line according to at least one of the presently disclosed embodiments.
Figure 8:
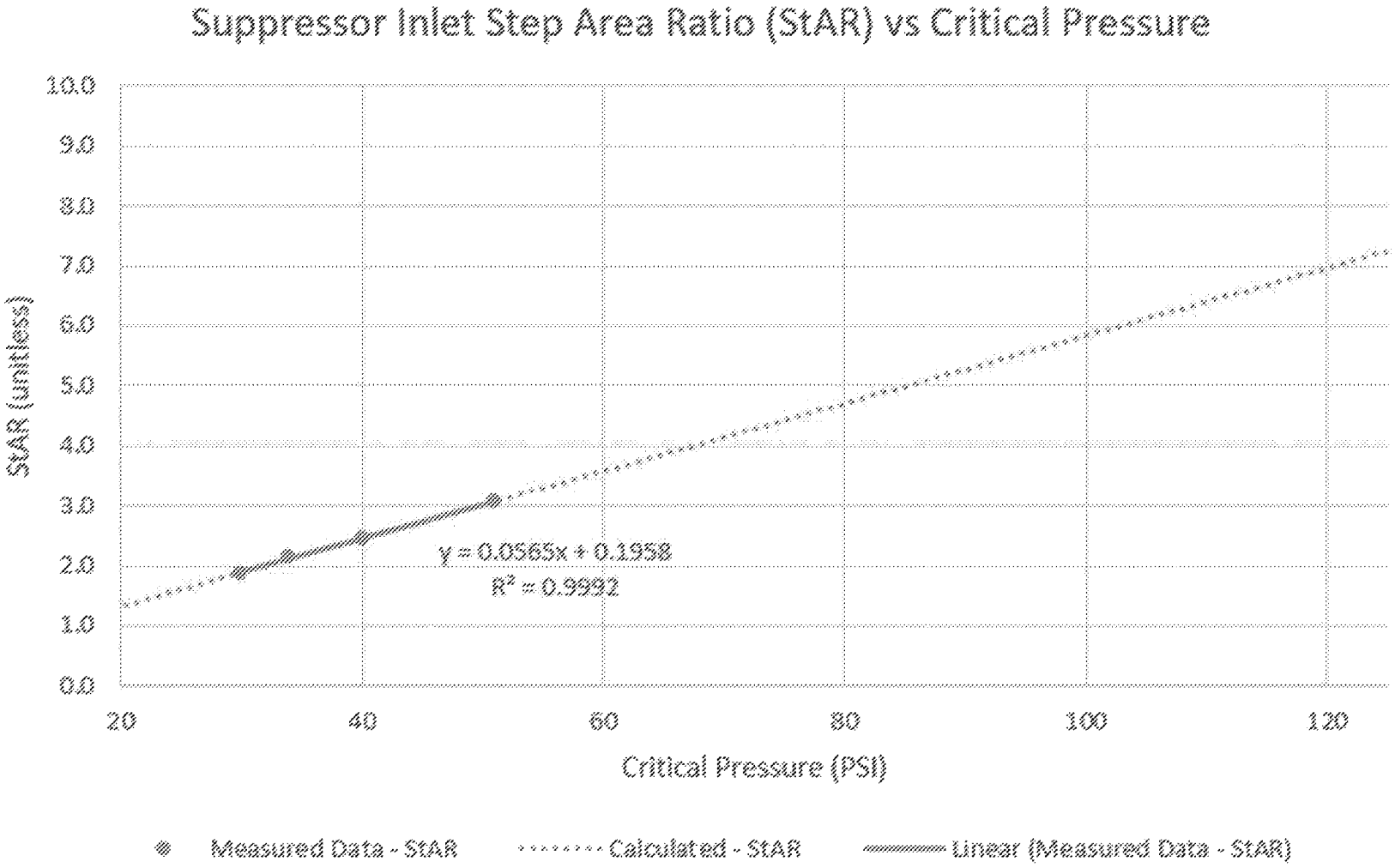
FIG. 8 illustrates a graph of the suppressor inlet Step Area Ratio (StAR) (y axis) relative to the critical pressure (x axis) and the formula of the resulting line according to at least one of the presently disclosed embodiments.

As shown in FIGS. 6-8, advantageous geometric values of the liner 110 and suppressor 115 can be determined experimentally by maintaining a constant cross-sectional area liner outlet 135, and varying the critical pressure and cross-sectional area of the suppressor inlet 145. The noise level in decibels can then be plotted based on the different nozzle inlet pressures for different cross-sectional areas of the suppressor inlet 145. The lowest noise level point of these plots can then be determined to be the critical pressure and suppressor inlet 145 cross-sectional area for the given cross-sectional area of the nozzle liner outlet 135. These points can then be plotted as the suppressor inlet 145 cross-sectional area based on the critical pressure, and an equation can be estimated using least squares or another conventional method to achieve a formula that describes generally an advantageous suppressor inlet 145 cross-sectional area relative to a critical pressure for a given nozzle liner outlet 135 cross-sectional area. The step area ratio (i.e., a ratio of the suppressor inlet 145 cross-sectional area divided by the area of the nozzle outlet liner 135 cross-sectional area) can then be calculated for future applications.

FIG. 6 illustrates a graph of the sound pressure level (y axis) relative to the nozzle inlet pressure (x axis) for four separate suppressor inlet 145 cross-sectional areas according to at least one of the presently disclosed embodiments. This graph can therefore be used to determine the sound level of certain blasting apparatus systems and to determine when the sound is lowest, or "bottoms out" on the graph so as to achieve the maximum noise suppression. As shown, the suppressor inlet 145 can have cross-sectional areas of 0.72 $in^2$ (top plot at 20 psig), 0.58 $in^2$ (second highest plot at 20 psig), 0.50 $in^2$ (second lowest plot at 20 psig), and 0.44 $in^2$ (lowest plot at 20 psig). The nozzle inlet pressure was then varied from 20 psig to 51 psig and the corresponding noise levels were measured. As shown, a suppressor 115 with suppressor inlet 145 cross-sectional area of 0.72 $in^2$ achieves maximum noise suppression at about 51 psig, reaching a noise level of 103.88 dB. For the 0.58 $in^2$, 0.50 $in^2$, and 0.44 $in^2$ suppressor inlet 145 cross-sectional areas, the most advantageous nozzle inlet pressures were 40 psig, 34 psig, and 30 psig, respectively.

FIG. 7 illustrates a graph of the suppressor inlet area (y axis) relative to the critical pressure (x axis) based on the data points provided by plots of the four separate suppressor inlet areas and the formula of the resulting line according to at least one of the presently disclosed embodiments. As shown, the values determined in FIG. 6 are plotted in FIG. 7 and a linear model is then generated using well known mathematical processes. For example, the 0.72 $in^2$ suppressor inlet 145 cross-sectional area is plotted at 51 PSI, the critical pressure at which maximum noise suppression is obtained based on the lowest point on the FIG. 6 plot. For the same reasons the 0.58 $in^2$, 0.50 $in^2$, and 0.44 $in^2$ suppressor inlet 145 cross-sectional areas are plotted at 40 PSI, 34 PSI, and 30 PSI, respectively. Using these data points a linear equation can be determined as $A_{inlet}=0.0133*P_{crit}+0.0462$ for other critical pressures of inlet areas of suppressors 115 (where $A_{inlet}$ is the cross-sectional area of the suppressor inlet 145 and $P_{crit}$ is the critical pressure at which the nozzle 100 and suppressor 115 can be used.

FIG. 8 illustrates a graph of the suppressor inlet Step Area Ratio (StAR) (y axis) relative to the critical pressure (x axis) and the formula of the resulting line according to at least one of the presently disclosed embodiments. The StAR is the ratio of the cross-sectional area of the suppressor inlet divided by the cross-sectional area of the nozzle liner outlet 125. Similar to FIG. 7, the values are plotted based on the experimental data and a linear regression is performed to estimate an equation to be used for other critical pressures or StAR values.

It is also envisioned herein that the suppressor system can be used where it may be securely attached to an exhaust system for which sound suppression is desired. For example, the optimal area, StAR, or area of the suppressor may be determined using the above process for, e.g., an airplane engine, an engine exhaust, blow down air guns, compressed air discharge vents, and the like.

While the invention has been described herein with references to the figures, many variations and modification can be made to the embodiments described herein without substantially departing from the principles of the present invention. Such variations and modifications are intended to be included herein within the scope of the present invention, as set forth in the following claims.

We claim:

1. A nozzle comprising:

a nozzle liner having a liner inlet receiving air or fluid and a liner outlet distributing the air or fluid, and a liner body extending therebetween;

a suppressor including:

a suppressor inlet located adjacent the liner outlet at a first end of the suppressor and receiving the air or fluid from the liner outlet;

a suppressor outlet located at a second end of the suppressor opposite the first end;

a suppressor body extending from the suppressor inlet to the suppressor outlet;

an entrance length extending from the suppressor inlet in an axial direction;

an exit length extending from the entrance length and having an exit length cross-sectional area that remains substantially the same as a distance from the suppressor inlet increases; and an interface located at an intersection of the entrance length and the exit length, wherein the exit length extends from the interface to the suppressor outlet.

2. The nozzle of claim 1, further comprising a nozzle jacket having a first jacket end and a second jacket end opposite the first jacket end, and wherein the liner inlet is located within the nozzle jacket proximate the first end.

3. The nozzle of claim 1, wherein an entrance length cross-sectional area remains substantially the same as a distance from the nozzle liner outlet towards the interface increases.

4. The nozzle of claim 2, wherein the entrance length cross-sectional area and the exit length cross-sectional area are substantially the same.

5. The nozzle of claim 2, wherein a shape and size of an entrance length cross-sectional area and the exit length cross-sectional area is substantially the same.

6. The nozzle of claim 1, wherein the suppressor inlet is substantially circular.

7. The nozzle of claim 1, wherein the suppressor outlet is substantially non-circular.

8. The nozzle of claim 1, wherein a suppressor inlet diameter is larger than a liner outlet diameter so as to create a stepped interface between the nozzle liner and the suppressor.

9. The nozzle of claim 1, wherein the nozzle liner and the suppressor are integral with one another.

10. The nozzle of claim 1, wherein the nozzle liner and the suppressor are separate components removably coupled to one another.

11. The nozzle of claim 1, wherein a ratio between cross-sectional areas of the suppressor inlet and the liner outlet is between about 1.5 and 7.

12. A suppressor for use in a nozzle having a nozzle liner with a liner inlet and a liner outlet, the suppressor comprising:

a suppressor inlet located adjacent the liner outlet at a first end of the suppressor and receiving the air or fluid from the liner outlet;

a suppressor outlet located at a second end of the suppressor opposite the first end;

a suppressor body extending from the suppressor inlet to the suppressor outlet;

a length extending from the suppressor inlet in an axial direction and having a length cross-sectional area that is substantially constant along the length as a distance from the suppressor inlet increases.

13. The suppressor of claim 12, wherein an inlet diameter of the suppressor is larger than a nozzle liner outlet diameter so as to create a stepped interface between the nozzle liner and the suppressor.

14. The suppressor of claim 12, wherein a ratio between cross-sectional areas of the suppressor inlet and the liner outlet is between about 1.5 and 7.

15. The suppressor of claim 12, wherein the nozzle liner and the suppressor are separate components removably coupled to one another.

16. The suppressor of claim 12, wherein the length includes an entrance length extending from the suppressor inlet to an interface, and an exit length extending from the interface to the suppressor outlet.

17. The suppressor of claim 12, wherein the suppressor inlet is substantially circular.

18. The suppressor of claim 12, wherein the suppressor outlet is substantially non-circular.

19. The suppressor of claim 16, wherein a ratio between a cross-sectional area of the interface and the liner outlet is between about 1.5 and 7.

* * * * *